US010156131B2

(12) United States Patent
Bazhal et al.

(10) Patent No.: US 10,156,131 B2
(45) Date of Patent: Dec. 18, 2018

(54) METHOD OF THROUGH-WELLBORE EXTRACTION OF SUBSOIL RESOURCES

(71) Applicant: Galex Energy Corp., Houston, TX (US)

(72) Inventors: Anatolii Bazhal, New Caney, TX (US); Alexander Barak, Houston, TX (US)

(73) Assignee: Galex Energy Corp., Houston, TX (US)

( * ) Notice: Subject to any disclaimer, the term of this patent is extended or adjusted under 35 U.S.C. 154(b) by 0 days.

(21) Appl. No.: 15/616,612

(22) Filed: Jun. 7, 2017

(65) Prior Publication Data

US 2018/0283150 A1 Oct. 4, 2018

(51) Int. Cl.
*E21B 43/26* (2006.01)
*E21B 43/24* (2006.01)

(52) U.S. Cl.
CPC ..... *E21B 43/2401* (2013.01); *E21B 43/2405* (2013.01); *E21B 43/26* (2013.01)

(58) Field of Classification Search
CPC ... E21B 43/2401; E21B 43/2405; E21B 43/26
USPC ..... 166/248
See application file for complete search history.

(56) References Cited

U.S. PATENT DOCUMENTS 4,886,118 A * 12/1989 Van Meurs ..... E21B 36/04 166/245
8,087,460 B2 * 1/2012 Kaminsky ..... E21B 36/04 166/245
2008/0087426 A1 * 4/2008 Kaminsky ..... E21B 36/001 166/271
2017/0241248 A1 * 8/2017 Barak ..... E21B 43/243

* cited by examiner

*Primary Examiner* — Silvana C Runyan
(74) *Attorney, Agent, or Firm* — Kelly & Kelley, LLP

(57) ABSTRACT

This invention relates to downhole resource extraction technology and may be used to recover crude oil, gas, asphalt, coal, radioactive and rare metals, nonferrous and precious metals, and underground sulfur. This method of downhole resource extraction includes: penetrating a productive formation with conventional wells; generating thermal energy directly within said formation on a capillary microlevel by running an electric current through a natural or artificially created conductive part of the formation to establish a high-temperature channel in said formation; and setting and maintaining a controllable design temperature within specified sections of the formation. The design temperature will be set based on the type of resource to be recovered and is intended to keep specified parameters of the target resource in a flowing state. This method enhances recovery efficiency of subsoil resources while improving operational profitability through reductions in energy consumption, production costs, time, and environmental footprint.

12 Claims, No Drawings

METHOD OF THROUGH-WELLBORE EXTRACTION OF SUBSOIL RESOURCES

FIELD OF THE INVENTION

The utility model presented in this disclosure relates to downhole resource extraction technology and may be used to recover crude oil, gas, asphalt, coal, radioactive and rare metals, nonferrous and precious metals, and underground sulfur.

BACKGROUND OF THE INVENTION

This method answers two current challenges: 1) how to enhance the efficiency of through-wellbore extraction of subsoil resources and 2) how to improve the profitability of the extraction regime.

A key strategy in enhancing the efficiency of through-wellbore recovery of subsoil resources and improving the profitability of the extraction regime is to increase the temperature of target formations to intensify the extraction process.

As of today, these technologies are considered cutting-edge and hold considerable promise for future refinement.

For example, increasing oil recovery from target formations by up to 50-60% by raising the temperature of these formations is equivalent to doubling the volume of commercial oil reserves. By elevating the temperature of a reservoir to 120° C., oil recovery from that formation may be increased by 80%.

Increasing the temperature of reservoirs during through-wellbore recovery of rare, radioactive, non-ferrous and precious metals reduces the time needed to convert these resources into a solution and consequently, accelerates the development of said resources by several times while simultaneously raising their respective recovery factors.

Controlling the temperature field during underground extraction of sulfur will make it possible to localize said temperature field within the reservoir, lower the cost of recovery and reduce the environmental impact of the process.

Heating a gas reservoir blocked by water, process fluid or retrograde condensate solves the costly problem of eliminating the blockage and will therefore reduce the time required for reservoir development while increasing gas recovery.

An essential requirement of this process is to achieve optimum control of the temperature regime for each type of resource to be recovered.

Documented methods exist for through-wellbore recovery of subsoil resources (hydrocarbons) based on heating a reservoir by injecting it with pressurized hot water or superheated steam.

This approach consists of thermal-steam treatment of a reservoir by heating water to a temperature lower than its evaporation point in specially designed heating units located on the surface, and then injecting the heated water through the wellbore into the target formation. A more effective variant of this method is to heat the water to the temperature of superheated steam prior to injection.

The main drawbacks of thermal-steam treatment are:

- rapid water-cutting of the target resource;
- negative impact of high temperatures on the wellbore and wellhead equipment;
- destruction of the rock matrix accompanied by extensive sand sloughing into the wellbore;
- spontaneous formation of oil/water emulsions.

The field of application of thermal-steam treatment for oil reservoirs is limited to the following:

- oil-saturation is less than 40%;
- porosity is less than 20%;
- oil-saturated thickness is no less than 6 m.;
- permeability is less than $100*10^{-3}$ $\mu m^2$;
- net-to-gross ratio is less than 0.5;
- a high degree of permeability stratification is present;
- oil viscosity is high (greater than 1000 mPa*s);
- reservoir-scale fracturing is present;
- zonal heterogeneity of permeability is present within the reservoir;
- high degree of reservoir discontinuity is present;
- the depth of reservoir occurrence is significant (more than 1000 m) and reservoir pressure is high;
- rock pressure in shallower reservoirs is too low to avoid hydraulic fracturing of the reservoir during steam injection.

The process of thermal-steam treatment is effective when the steam /oil ratio is less than 13 t/t (amount of steam per metric ton of oil). It is documented that one metric ton of oil must be burned to obtain 13 tons of steam.

The closest approximation to the technical solution presented in this disclosure is primarily focused on the recovery of liquid hydrocarbons [2] and includes penetrating a reservoir with conventional wells and generating thermal energy directly within said formation via in-situ combustion (fireflooding). Fireflooding is a thermal oil production method that is based on generating heat directly within an oil reservoir as opposed to thermal treatment, which involves injecting a thermal agent downhole into the reservoir from the surface.

When performing this method of fireflooding, in-situ oil combustion is initiated and maintained via the injection of air. The oxygen in the air reacts with fuel (oil), forming $CO_2$ and water, accompanied by the release of heat. The amount of energy (heat) thus released will depend on the composition of the crude oil. The burning of heavy oils will result in the release of approximately 42-46 thousand kj/kg of energy.

In some reservoirs, the oil may ignite spontaneously, while in others, preliminary heating will be required.

The chemical reaction between the oxygen contained in injected air and the in-situ oil may also result in the release of heat without combustion. Depending on the composition of the oil, the speed of this oxidation process may be sufficient to increase temperature to a point at which the oil is ignited. Otherwise, oil combustion may be initiated with the help of bottomhole heaters, or by injection of pre-heated air or preliminary injection of highly reactive oil, or through the use of combustion catalysts.

Other deficiencies inherent in this method of in-situ combustion are the following:

- inefficient distribution of heat during in-situ combustion resulting from the fact that a significant heating zone forms behind the combustion front;
- damage to bottomhole equipment and the well casing of producing wells under the impact of temperature (up to 650° C.) and the onset of corrosion after propagation of a combustion front;
- reduced productivity resulting from gravitational stratification of the oil, occurring when air is channeled through the oil in the reservoir;
- environmental contamination caused by emission of harmful combustion products into the atmosphere during in-situ combustion;
- strong dependency of economic performance on reservoir and oil properties during in-situ combustion.

It should be noted that the following features of oil production via in-situ combustion may also be considered inadequacies of the method.

The parameter that best measures the cost effectiveness of the process of in-situ combustion is the ratio between the volume of injected air and the volume of oil produced through in-situ combustion. Experience has shown that when in-situ combustion is successfully implemented, this ratio is equal to 3600 $m^3/m^3$.

Furthermore, large volumes of an oxidizing agent (air, oxygen) must continuously be injected into the reservoir to maintain the combustion process. But this is only possible when the reservoir is adequately permeable. In many cases, permeability is too low and very unevenly distributed.

The reaction between oxygen and crude oil begins to intensify as temperature is increased, and the oil may auto-ignite sometime after a temperature of 100-150° C. has been reached.

At a temperature of approximately 260° C., hydrogen in the oil combusts and water and coke are exuded.

Coke burns at a temperature of 370° C.

Within the zone of the combustion front, heavy fuel (coke) burns at temperatures from 315° C. to 650° C.

Coke combustion requires the consumption of enormous amounts of air, thereby making it unprofitable to produce oil containing large amounts of heavy hydrocarbons.

Free oxygen may pass through the combustion front or bypass it through channels in the rock, creating serious safety issues in producing wells.

The in-situ combustion method is primarily used for oil production, and is not designed for the through-wellbore extraction of other subsoil resources.

The present invention fulfills these needs and provides other related advantages.

SUMMARY OF THE INVENTION

The present invention is directed to a process for through-wellbore extraction of subsoil resources. The process begins with penetrating a productive formation with one or more wellbores. Thermal energy is then generated directly within the productive formation at a capillary microlevel. A controllable design temperature is set within a predefined section of the productive formation, where the design temperature is based on a type of resource to be recovered from the productive formation. The design temperature is maintained so as to convert the type of resource to be recovered as a flowing fraction. The flowing fraction is removed through the one or more wellbores.

The generating step preferably includes passing an electric current through a conductive structure in or adjacent to the productive formation. The electric current establishes a high-temperature channel around the conductive structure. The conductive structure may be an artificially created conductive structure having predetermined conductivity parameters. The artificially created conductive structure is created either within the productive formation or in underlying or overlying subsoil layers.

The process preferably includes inducing hydraulic fractures in the productive formation by flowing a hydraulic fracturing liquid into the productive formation. Fine electrically conducting powders are injected into the hydraulic fractures together with the hydraulic fracturing liquid flowing into the productive formation. The artificially created conductive structure is preferably formed from the fine electrically conducting powders in the hydraulic fractures. The design temperature preferably exceeds a vaporization temperature of the type of resource to be recovered.

The hydraulic fractures are formed as continuations of oncoming fractures arriving from a specified number of wellbores in a recovery block.

The reservoir is preferably saturated with a mineralized fluid and the design temperature does not exceed a vaporization temperature of the flowing fraction.

Where the type of resource to be recovered is heavy oil, viscous oil, asphalt, or coal, the design temperature is preferably a temperature at which the type of resource to be recovered is converted into a vapor-phase or gaseous state. This process may also include passing compressed air through a high-temperature channel within the formation and establishing a high-temperature pyrolysis regime in the productive formation to convert heavy fractions of the type of resource to be recovered.

Where the type of resource to be recovered is natural gas from a gas reservoir and capillaries of the gas reservoir are blocked by water, process fluid or retrograde condensate, the process may also include raising the design temperature to a vaporization point of the water, process fluid or retrograde condensate.

Where the type of resource to be recovered is shale hydrocarbons, the process may also include raising the design temperature so as to generate excess capillary pressure in the productive formation.

Where the type of resource to be recovered is underground sulfur, the process may include raising the design temperature to a melting point of sulfur.

Where the type of resource to be recovered is metals, the process may include raising the design temperature to a point that supports conversion of the metals into a solution and converting the metals into a solution for the flowing fraction.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

The utility model presented here is designed to create a method of through-wellbore extraction of subsoil resources based on in-situ heating of reservoirs in a way that improves the efficiency of through-wellbore extraction of different types of subsoil resources and significantly increases the profitability of the recovery process, while lowering energy consumption and production costs, and significantly reducing the time required to develop these resources and the environmental impact of the process.

Like the documented method of through-wellbore extraction of subsoil resources, the solution presented here includes penetrating a reservoir with conventional wells and generating thermal energy directly within the formation, although in the new utility model, this thermal energy is generated at a capillary microlevel by passing an electric current through a natural or artificially created conductive part of the formation to establish a high-temperature channel in said formation, and setting and maintaining a controllable design temperature within specified sections of the formation. The design temperature will be set based on the type of resource to be recovered and is intended to keep specified parameters of the target resource in a flowing consistency.

In the process, an artificially created conductive part with predetermined conductivity parameters is created either within the reservoir or in its underlying or overlying layers.

Then, an alternating or direct current with design parameters and structure is run through the natural or artificially created conductive part of the formation.

A design temperature is specified that may or may not exceed the vaporization temperature of the flowing fraction in the reservoir.

A design temperature that does not exceed the vaporization temperature of the flowing fraction within the reservoir is achieved by saturating the reservoir with a mineralized fluid.

A design reservoir temperature that exceeds the vaporization temperature of the flowing fraction in the reservoir is achieved through the formation of induced hydraulic fractures and injection of fine electrically conducting powders into the reservoir together with the hydraulic fracturing fluid.

Hydraulic fractures are also formed as continuations of oncoming fractures arriving from a specified number of wells in the same recovery block.

During recovery of heavy and viscous oil, asphalt and coal, the temperature within the specified reservoir section is raised to the temperature at which these resources are converted into a vapor-phase or gaseous state.

During recovery of heavy and viscous oil, asphalt and coal, compressed air is passed through a high-temperature channel within the reservoir, and a high-temperature pyrolysis regime is established for heavy fractions.

During recovery of natural gas, if the reservoir capillaries are blocked by water, process fluid or retrograde condensate, the temperature of the specified reservoir section is raised to the vaporization point of the fluids causing the blockage.

During recovery of shale hydrocarbons, the temperature of the specified reservoir section is raised until excess capillary pressure is obtained.

During extraction of underground sulfur, the temperature of the specified reservoir section is raised to the sulfur melting point.

During the recovery of metals that have undergone in-situ conversion into a solution, the temperature of the specified reservoir section is raised to a point that supports the most rapid conversion of the metal into a solution.

Since thermal energy is generated directly within the reservoir at a capillary microlevel by passing an electric current through a natural or artificially created current-conducting part of the reservoir in order to establish a high-temperature channel in the reservoir, provide a controllable design temperature within specified sections of the reservoir, and create the design temperature field needed to maintain an efficient production process without the use of temperature-specific heat-transfer agents or supplementary fluids and gases to support the chemical reactions associated with heat transfer within the reservoir. Unlike all previously documented methods, the utility model presented here does not require heating of the entire reservoir, but only that part lying within the boundaries of the recovery block that may be produced within a specified short period of time.

The design temperature is based on the type of resource to be recovered and is intended to keep specified parameters of the target resource in a flowing consistency in order to achieve optimum performance at each stage of the recovery process for each specific type of resource.

An artificial conductive part with predetermined conductivity parameters may be created either within the reservoir or in its underlying or overlying layers to achieve the design ionic conductivity needed to raise the temperature of the target reservoir section.

Passing an alternating or direct electric current with specified parameters and structure through a natural or artificially created current-conducting part of a reservoir will result in rapid heating of the reservoir to design temperatures. This not only facilitates accelerated recovery of the target resource from the heated reservoir, but also makes it possible to dramatically reduce the cost of through-wellbore production of the resource, since the main operating expenses incurred in this production are those related to heating the reservoir.

Since a design temperature is specified that may or may not exceed the vaporization temperature of the flowing fraction in the reservoir, a controllable temperature regime is established in the selected reservoir section that is necessary to achieve optimum performance at each stage of the recovery process for each specific type of resource, e.g., oil, asphalt, coal, radioactive and rare metals, non-ferrous and precious metals and underground sulfur.

Since a design temperature that does not exceed the vaporization temperature of the flowing fraction within the reservoir is achieved by saturating the reservoir with a mineralized fluid, e.g. water with a specified level of mineralization or a process fluid, the planned ionic reservoir conductivity is attained, thereby making it possible to increase reservoir temperature to a point that does not exceed the vaporization temperature of the mineralized fluid (water).

Since a design reservoir temperature that exceeds the vaporization temperature of the flowing fraction in the reservoir is achieved through the formation of induced hydraulic fractures and injection, together with the hydraulic fracturing fluid, of fine electrically conducting powders in specified concentrations, e.g. graphite, aluminum dust, anthracite fines, etc., a pre-determined high temperature can be attained by initiating an electrical current of specified parameters and structure. Hydraulic fractures are also formed as continuations of oncoming fractures arriving from a specified number of wells in the same recovery block, thereby accelerating the fracturing process while ensuring that the fractures are distributed on the same plane, and resulting in intensified recovery of the target resource.

When producing heavy and viscous grades of oil, asphalt and coal, raising the temperature of the selected reservoir section to a point where these resources are converted to a vapor-phase or gaseous state will facilitate subsequent condensation of the vapor-phase fraction into liquid hydrocarbons in-situ or on the surface, while the gas fraction will be used as a marketable fuel.

Raising reservoir temperature to the melting point of heavy hydrocarbons (naphthenes, asphaltenes, gums, paraffins) will facilitate downhole recovery of heavy and viscous grades of oil and asphalt, the proved reserves of which are seven times greater than the proved reserves of light crude oil.

Heating an oil reservoir to the vaporization temperature of the flowing media within it will increase the mobility of viscous crude oil by a factor of 2 to 3. This will improve well productivity by 10-30 times.

Since during recovery of heavy and viscous oil, asphalt and coal, compressed air is passed through a high-temperature channel within the reservoir and a high-temperature pyrolysis regime is established for heavy fractions, the efficiency of said recovery is significantly raised.

In-situ conversion of coal within a localized high-temperature field into its steam-gas fraction will enable to bring into commercial production the innumerable energy resources of coalfields at a much lower cost than hydrocarbon energy resources.

Raising the temperature of a gas reservoir blocked by water, process fluid or retrograde condensate to the evaporation point of the fluid causing the blockage will unblock the fine-capillary structures of the reservoir, and will therefore reduce the time required for reservoir development while increasing gas recovery.

Raising the temperature of the specified reservoir section during recovery of shale hydrocarbons until excess capillary pressure is obtained will increase the recovery factor and reduce the time required for reservoir development.

Raising the temperature of the specified reservoir section to the sulfur melting point during underground extraction of sulfur will reduce the time required for resource extraction, improve the recovery factor, lower the cost of recovery, and minimize the environmental impact of the process.

During extraction of a metal, increasing the temperature of the specified reservoir section to a temperature that maximizes the speed at which that metal is converted to a solution will reduce the time required for full reservoir development, improve the recovery factor and lower the cost of production by decreasing operating expenses.

The method of through-wellbore extraction of subsoil resources described in this disclosure is performed as follows:

The target reservoir is penetrated by a group of wells drilled according to a planned spacing pattern.

In a local section of the recovery block, thermal energy is generated directly within the reservoir by passing an electric current at a capillary microlevel through a natural conductive part of the reservoir, or in its absence, through an artificially created conductive part, to establish a high-temperature channel in said formation, through which an electric current is run, e.g. alternating or direct current, with design parameters and structure, thereby producing rapid heating of the reservoir to design temperatures. Heating of an optimal section of the reservoir is carried out over a period of one to three days.

The design heating temperature is based on the type of resource to be recovered and is intended to keep specified parameters of the target resource in a flowing consistency in order to achieve optimum performance at each stage of the recovery process for each specific type of resource.

An artificial conductive part with predetermined conductivity parameters may be created either within the reservoir or in its underlying or overlying layers to achieve the design ionic conductivity needed to raise the temperature of the target reservoir section.

Electrical energy to heat the reservoir is delivered to the reservoir through production wells or special-purpose The electric current delivered to the reservoir creates the design temperature field needed to maintain an efficient production process without the use of temperature-specific heat-transfer agents or supplementary fluids and gases to support the chemical reactions associated with heat transfer within the reservoir. This does not require heating of the entire reservoir, but only the part lying within the boundaries of the recovery block that may be produced within a specified short period of time. The reservoir section that is not planned for development at this time does not undergo heating, except for incidental warming by stray heat.

A design temperature is specified that may or may not exceed the vaporization temperature of the flowing fraction in the reservoir, which is determined based on the physicochemical properties of the target resource. Under the influence of the specified controllable temperature regime, the target resource is kept in a flowing consistency in order to achieve optimum performance at each stage of the through-wellbore recovery process for that type of resource, e.g. oil, gas, shale hydrocarbons, asphalt, coal, radioactive and rare metals, non-ferrous and precious metals, and underground sulfur.

A design temperature that does not exceed the vaporization temperature of the flowing fraction in the reservoir is achieved by saturating the natural or artificially created current-conducting part of the reservoir with a mineralized fluid, e.g. mineralized water or a process fluid. As a result, the electrical resistance of the reservoir, and consequently, heat output, does not raise the temperature of the reservoir above the evaporation point of the mineralized fluid, thereby keeping specified parameters of the target resource in a flowing consistency.

A design reservoir temperature that exceeds the vaporization temperature of the flowing fraction in the reservoir is achieved through the formation of induced hydraulic fractures and injection of fine, highly electrically conducting materials into the reservoir together with the hydraulic fracturing fluid.

Hydraulic fractures are also formed as continuations of oncoming fractures arriving from a specified number of wells in the same recovery block. As a result, connected hydraulic fractures are created that cover the specified reservoir section at a design depth.

Fine, highly electrically conducting materials (e.g. graphite, aluminum powder, fine anthracite fractions, etc.) are injected into the hydraulic fractures as a propant together with the hydraulic fracturing fluid. These materials are injected in a design concentration needed to ensure a high temperature during the passing of an electrical current of specified parameters and structure.

During recovery of heavy and viscous grades of oil, asphalt and coal of all types, the temperature of the specified reservoir section is raised the temperature at which these resources are converted to a flowing consistency, including vapor-phase or gaseous states. These resources are then recovered while in these states, which significantly reduces the time required for recovery, while improving the recovery factor and the general efficiency of production.

To recover heavy and viscous oil, asphalt and coal, compressed air is passed through a high-temperature channel within the reservoir, and a high-temperature pyrolysis regime is established for heavy fractions. At the start of the process, a part of the current-conducting reservoir undergoes rapid heating under the influence of an electrical current, accompanied by the formation of a high-temperature channel. After the design temperature has been reached, electrical heating is stopped and compressed air is passed through the high-temperature channel. This results in high-temperature pyrolysis of heavy fractions with a self-sustaining temperature regime (up to 5000 C). This yields significant savings in time and money, while improving the efficiency of production.

Heavy and viscous oil, asphalt and coal are converted into a vapor-phase or gaseous consistency with subsequent condensation of their vapor-phase fractions in-situ or on the surface into liquid hydrocarbons, while the gas fraction will be used as a marketable fuel.

To recover natural gas from a gas reservoir blocked by water, process fluid or retrograde condensate, the capillary structures of the gas reservoir must first be unblocked. This is accomplished by raising the temperature of the specified section of the gas reservoir to the evaporation point of the blocking fluids. This significantly reduces the time required for full reservoir development while increasing total gas recovery.

To extract shale hydrocarbons, the temperature of the specified reservoir section is raised until excess capillary pressure is obtained. This improves the recovery factor while reducing the time required for reservoir development.

At present, the recovery efficiency of shale hydrocarbons ranges from 6 to 12%. Increasing the temperature of the specified reservoir section until excess capillary pressure is obtained will increase the recovery factor by up to 60-70%.

To extract underground sulfur, a localized electric heater is used to raise the temperature of the specified reservoir section to the sulfur melting point. As a result, the initial non-flowing medium is converted into a flowing consistency for subsequent recovery. This makes it possible to reduce the time needed to extract the sulfur by up to 30% at a significantly higher sulfur recovery factor, while lowering production costs by up to 20%. This technology also enhances the environmental safety of the extraction process.

During the recovery of metals, the temperature of the specified reservoir section is raised by heating the current-conducting part of the reservoir via an electric current to a point that supports the most rapid conversion of the metal into a solution for subsequent extraction of the metal in a flowing consistency.

This process reduces the time required for full reservoir development, improves the recovery factor and lowers the cost of production by decreasing operating expenses.

Using this technology, the conversion of metals (e.g. radioactive and rare metals, non-ferrous and precious metals) into a solution is intensified during through-wellbore extraction, and the recovery factors for all grades of oil, including viscous and heavy oils, are increased (by up to 70%) as are those for shale (dissipated) hydrocarbons, gas, asphalt, all types of coal, and sulfur, while reducing the time needed for full reservoir development.

The main reason for the cost effectiveness of this method of subsoil resource extraction is that it achieves a multifold reduction in reservoir heating time and consequently, the time required to fully develop the reservoir within the recovery block.

Below is an example of oil recovery based on a reservoir with the following characteristics:

sand porosity=30%, oil saturation=75% water saturation=25%, each cubic meter of reservoir volume contains 0.225 cubic meters of oil.

When a cubic meter of the reservoir is heated in-situ from 20° C. to 315° C., about 0.035 cubic meters of the oil is expended, or 15.5% of the reserves contained within it.

The loss of heat through the reservoir top and base is 40%.

In this case, the heat availability factor per unit of time will not exceed 15%.

As heating time and oil extraction time are increased, cumulative heat losses grow proportionately.

In this example, energy consumption is based on heating one cubic meter of the target reservoir. If the recovery block is one million cubic meters in volume, the quantities expressed here are multiplied by one million.

In actual operating conditions, when a heat-transfer agent is used to deliver heat downhole, about 15-17% of the energy is lost in the wellbore. Energy losses to the surrounding rock can reach 40%. Energy losses with the recoverable product can reach 20%. Energy losses with the recoverable product can reach 20%. Up to ⅓ of the energy delivered is used to heat the reservoir matrix.

Cost-effective resource extraction can only be achieved via rapid recovery of the target resource from a rapidly heated reservoir.

It is well documented that under in-situ combustion (fireflooding)—currently the fastest method of reservoir heating—the radius of the combustion front will reach approximately 16 meters after two years of air injection into the reservoir.

Optimum air injection parameters established experimentally for fireflooding support a maximum combustion-front advance rate of only 10 cm per 24 hours.

The drainage rate of the flowing medium in an oil reservoir will range from 1 m/hour to 100 m/hour depending on permeability, the flowability of the medium, and pressure drawdown.

In contrast, after the reservoir has been rapidly heated via an electric current for 3 to 5 days and the target fluid is rapidly pumped out of the heated reservoir, the technology described in this disclosure will extract the target resource at a rate that is 10 to 30 times faster than under the current reservoir-heating method. This will result in a 10 to 30-fold reduction in operating expenses, the bulk of which under the current method are dedicated to heating the reservoir. This will significantly reduce the overall cost of through-wellbore extraction of the target resource.

The method described in this disclosure has been successfully tested in the production of oil (including viscous and heavy oil), shale (dissipated) hydrocarbons, gas, asphalt, all types of coal, sulfur, and metals.

Under the method described in this disclosure, through-wellbore extraction of fluid and gaseous energy resources from asphalt and otherwise unrecoverable heavy and viscous grades of oil will result in the recovery of price-competitive, marketable products at a cost that is up to 3 times lower than current through-wellbore production of conventional hydrocarbons such as oil and gas.

Under the method described in this disclosure, through-wellbore extraction of fluid and gaseous energy resources from coal fields (lignite, hard coal, and anthracite) will result in the recovery of price-competitive, marketable products at a cost that is up to 5 times lower than current through-wellbore production of hydrocarbons.

Under the method described in this disclosure, through-wellbore extraction of metals (radioactive, rare, non-ferrous, precious) by converting them in-situ into a solution via reservoir heating will accelerate the conversion process and consequently reduce the operating time to needed to reach reservoir depletion from 3-6 years to 2-3 years, with a proportionate decrease in the cost of production owing to lower operating expenses.

This method also solves the complex technological and economic challenge of opening the fine-capillary structures of gas reservoirs blocked by water, process fluids or retrograde condensate, resulting in a 30-50% reduction in production costs by decreasing the operating time needed to reach full reservoir development, with consequently lower operating expenses, while achieving significantly higher recovery factors.

The method described in this disclosure solves the complex technological and economic challenges associated with through-wellbore extraction of shale (dissipated) hydrocarbons by reducing production costs while improving recovery factors. By increasing the temperature of the target shale formation, this method will raise the recovery factor from the current 6-12% to a theoretically possible 60-70% based solely on economic considerations.

Under the method described in this disclosure, underground sulfur is extracted by heating the reservoir section to the sulfur melting point via a localized electric current, resulting in as much as a 30% reduction in the time required to fully develop the reservoir and up to a 20% decrease in the cost of production.

Therefore, the method described in this disclosure improves the technical and economic efficiency of the extraction of various types of subsoil resources while significantly increasing profitability by reducing energy consumption, lowering the cost of production, and minimizing the time required for full reservoir development. This technology also enhances the environmental safety of the extraction process.

Although several embodiments have been described in detail for purposes of illustration, various modifications may be made without departing from the scope and spirit of the invention. Accordingly, the invention is not to be limited, except as by the appended claims.

What is claimed is:

1. A process for through-wellbore extraction of heavy oil, viscous oil, asphalt, or coal from subsoil resources, comprising the steps of:

penetrating a productive formation of the subsoil resources with one or more wellbores;

generating thermal energy, on a capillary microlevel, directly within the productive formation;

setting a controllable design temperature within a predefined section of the productive formation, wherein the design temperature is a vaporization temperature of the heavy oil, viscous oil, asphalt, or coal to be extracted from the productive formation so as to convert the heavy oil, viscous oil, asphalt, or coal into a vapor-phase or a gaseous state;

maintaining the design temperature in the predefined section of the productive formation so as to establish a vaporization temperature channel around the productive formation;

passing compressed air through the vaporization temperature channel;

establishing a vaporization temperature pyrolysis regime in the productive formation to convert the heavy oil, viscous oil, asphalt, or coal to be extracted into a flowing fraction; and removing the flowing fraction through the one or more wellbores.

2. The process of claim 1, wherein the generating step includes passing an electric current through a conductive structure in or adjacent to the productive formation, wherein the electric current establishes the vaporization temperature channel around the conductive structure.

3. The process of claim 2, wherein the conductive structure is an artificially created conductive structure having predetermined conductivity parameters.

4. The process of claim 3, wherein the artificially created conductive structure is created either within the productive formation or in underlying or overlying subsoil layers.

5. The process of claim 4, further comprising the steps of:

inducing hydraulic fractures in the productive formation by flowing a hydraulic fracturing liquid into the productive formation;

injecting fine electrically conducting powders into the hydraulic fractures together with the hydraulic fracturing liquid flowing into the productive formation;

forming the artificially created conductive structure from the fine electrically conducting powders in the hydraulic fractures; and wherein the design temperature exceeds a vaporization temperature of the heavy oil, viscous oil, asphalt, or coal to be extracted.

6. The process of claim 5, wherein the hydraulic fractures are formed as continuations of oncoming fractures arriving from a specified number of wellbores in a recovery block.

7. The process of claim 1, further comprising the step of saturating the productive formation with a mineralized fluid.

8. The process of claim 7, wherein the design temperature does not exceed a vaporization temperature of the heavy oil, viscous oil, asphalt, or coal to be extracted.

9. A process for through-wellbore extraction of natural gas from a gas reservoir, wherein capillaries of the gas reservoir are blocked by a liquid comprising water, process fluid of retrograde condensate, comprising the steps of:

penetrating a productive formation of natural gas in the gas reservoir with one or more wellbores;

generating thermal energy, on a capillary microlevel, directly within the productive formation;

setting a controllable design temperature within a predefined section of the productive formation, wherein the design temperature is a vaporization temperature of the liquid blocking the capillaries of the gas reservoir;

maintaining the design temperature in the predefined section of the productive formation so as to vaporize the liquid blocking the capillaries of the gas reservoir and release the natural gas to be extracted as a flowing fraction; and removing the flowing fraction through the one or more wellbores.

10. A process for through-wellbore extraction of shale hydrocarbons from subsoil resources, comprising the steps of:

penetrating a productive formation of shale hydrocarbons in the subsoil resources with one or more wellbores;

generating thermal energy, on a capillary microlevel, directly within the productive formation;

setting a controllable design temperature within a predefined section of the productive formation, wherein the design temperature is sufficient for vaporization of the shale hydrocarbons to generate excess capillary pressure in the productive formation;

maintaining the design temperature in the predefined section of the productive formation so as to convert the shale hydrocarbons to be extracted into a flowing fraction; and removing the flowing fraction through the one or more wellbores.

11. A process for through-wellbore extraction of underground sulfur from subsoil resources, comprising the steps of:

penetrating a productive formation of underground sulfur in the subsoil resources with one or more wellbores;

generating thermal energy, on a capillary microlevel, directly within the productive formation of the underground sulfur;

setting a controllable design temperature within a predefined section of the productive formation of underground sulfur, wherein the design temperature is the melting point of the underground sulfur to be extracted from the productive formation;

maintaining the design temperature in the predefined section of the productive formation so as to convert the underground sulfur to be extracted into a flowing fraction; and removing the flowing fraction through the one or more wellbores.

12. A process for through-wellbore extraction of metals from subsoil resources, comprising the steps of:

penetrating a productive formation of the metals in the subsoil resources with one or more wellbores;

generating thermal energy, on a capillary microlevel, directly within the productive formation;

setting a controllable design temperature within a predefined section of the productive formation, wherein the design temperature is sufficient to convert the metals to be extracted from the productive formation into a solution;

maintaining the design temperature in the predefined section of the productive formation so as to convert the metals to be extracted into a flowing fraction; and removing the flowing fraction through the one or more wellbores.

* * * * *